US005179312A

United States Patent [19]

Vriens et al.

[11] Patent Number: 5,179,312

[45] Date of Patent: Jan. 12, 1993

[54] TELEVISION PROJECTION SYSTEM HAVING FRAME WITH INTEGRAL COOLING

[75] Inventors: Leendert Vriens; Gerrit B. Gerritsen, both of Eindhoven, Netherlands

[73] Assignee: U.S. Philips Corporation, New York, N.Y.

[21] Appl. No.: 859,299

[22] Filed: May 5, 1986

[30] Foreign Application Priority Data

Mar. 25, 1986 [NL] Netherlands ..... 8600752

[51] Int. Cl.[5] ..... H01J 7/26; H01J 29/86

[52] U.S. Cl. ..... 313/12; 313/36; 313/477 R; 362/294; 165/104.33

[58] Field of Search ..... 313/477 R, 12, 36; 362/294; 165/104.33

[56] References Cited

U.S. PATENT DOCUMENTS 4,511,927 4/1985 Bauer ..... 313/12

FOREIGN PATENT DOCUMENTS 111979 6/1984 European Pat. Off. ..... 313/12

2134702 8/1984 United Kingdom .

*Primary Examiner*—Albert W. Davis, Jr.

*Attorney, Agent, or Firm*—John C. Fox

[57] ABSTRACT

Device for projecting television pictures by means of an assembly of three television picture tubes with associated lens systems arranged in each other's proximity, including an integrated cooling system. The integrated cooling system has a liquid circuit comprising a first duct extending below the television picture tubes, which duct is in direct communication via passages with the lower ends of the flow spaces, and a second duct extending above the television picture tubes, which duct is in direct communication via passages with the upper ends of the flow spaces. The first and the second duct are connected via at least one connection duct which extends along an end the assembly constituted by the three television picture tubes.

13 Claims, 5 Drawing Sheets

TELEVISION PROJECTION SYSTEM HAVING FRAME WITH INTEGRAL COOLING

BACKGROUND OF THE INVENTION

The invention relates to a device for projecting television pictures onto a projection screen by using three television picture tubes arranged side by side. Each tube has a display window having a display screen provided on the inside thereof (a phosphor layer on the vacuum side coated with a thin Al-film is common practice) and a light transmissive element arranged at a distance in front of the display window, which element together with the display window bounds a flow space for passing through a coolant. The flow spaces are in open communication with a liquid circuit for removing the heated coolant from and applying cooled liquid to the flow spaces. The light-transmissive element may be a window or a part of a lens system within the scope of the invention A device having three juxtaposed television picture tubes is known from British Patent Specification 2,131,702 in which the flow spaces are arranged in series and in which a pump is used for the coolant. Chambers constituting the connection between the successive flow spaces are located between the juxtaposed television picture tubes This system is suitable for an energy dissipation of 60 to 80 watts per tube and has a satisfactory operation.

For many conventional uses, however, such a construction is too expensive whilst a considerably smaller heat dissipation can suffice. In the present-day projectors for consumer uses an energy dissipation of 10 to 20 W per tube is common practice.

A device suitable for a smaller heat dissipation up to 25 to 30 W per tube is described in European Patent Application 0,162,971, to which U.S. application Ser. No. 738,199 corresponds. This application describes a free convection cooling in which a closed liquid cooling system is provided around the front side of the tube. The coolant (lows upwards in front of the tube and flows back via a passage provided near the upper side of the tube and via further passages provided along the ends of the tube to a passage arranged under the tube from which the liquid can flow upwards again. The air circulating freely around the cooling system ensures a sufficient cooling of the liquid flowing through the passages from the upper side of the tube to the lower side of the tube. For a satisfactory operation it is required that the passages have a sufficiently large cross-section. This implies that the distance between the juxtaposed tubes is influenced to a considerable extent by the cross-section of the passages for the flow of the coolant extending along the sides of the tubes.

In connection with an optimum arrangement of the tubes with a view to obtaining the smallest possible distortions in the image on the projection screen it is required to have the smallest possible angles between the centre lines of the tubes among themselves and it is therefore desirable to arrange the tubes as closely together as possible.

SUMMARY OF THE INVENTION

According to the invention the liquid circuit comprises a first duct extending below the television picture tubes, which duet is in direct communication via respective passages with the lower ends of the flow spaces a second duct extends above the television picture tubes, which duct is in direct communication via respective passages with the upper ends of the flow spaces. The first and the second duct are connected via at least one connection duct extending along and end of the assembly constituted by the three television picture tubes.

When the construction according to the invention is used, the television picture tubes can be arranged closely together while yet achieving an effective convection cooling, because the liquid heated by the three display screens and rising in front of the display windows can pass through a system of ducts bypassing the picture tubes and, after having being cooled to a sufficient extent is applied again to the lower sides of the picture tubes. This system of ducts bypassing the picture tubes can be formed with a sufficiently large cross-section and with sufficiently large cooling surfaces without affecting the mutual distance between the display tubes.

DETAILED DESCRIPTION OF THE PREFERRED EMBODIMENT

Figure 1:
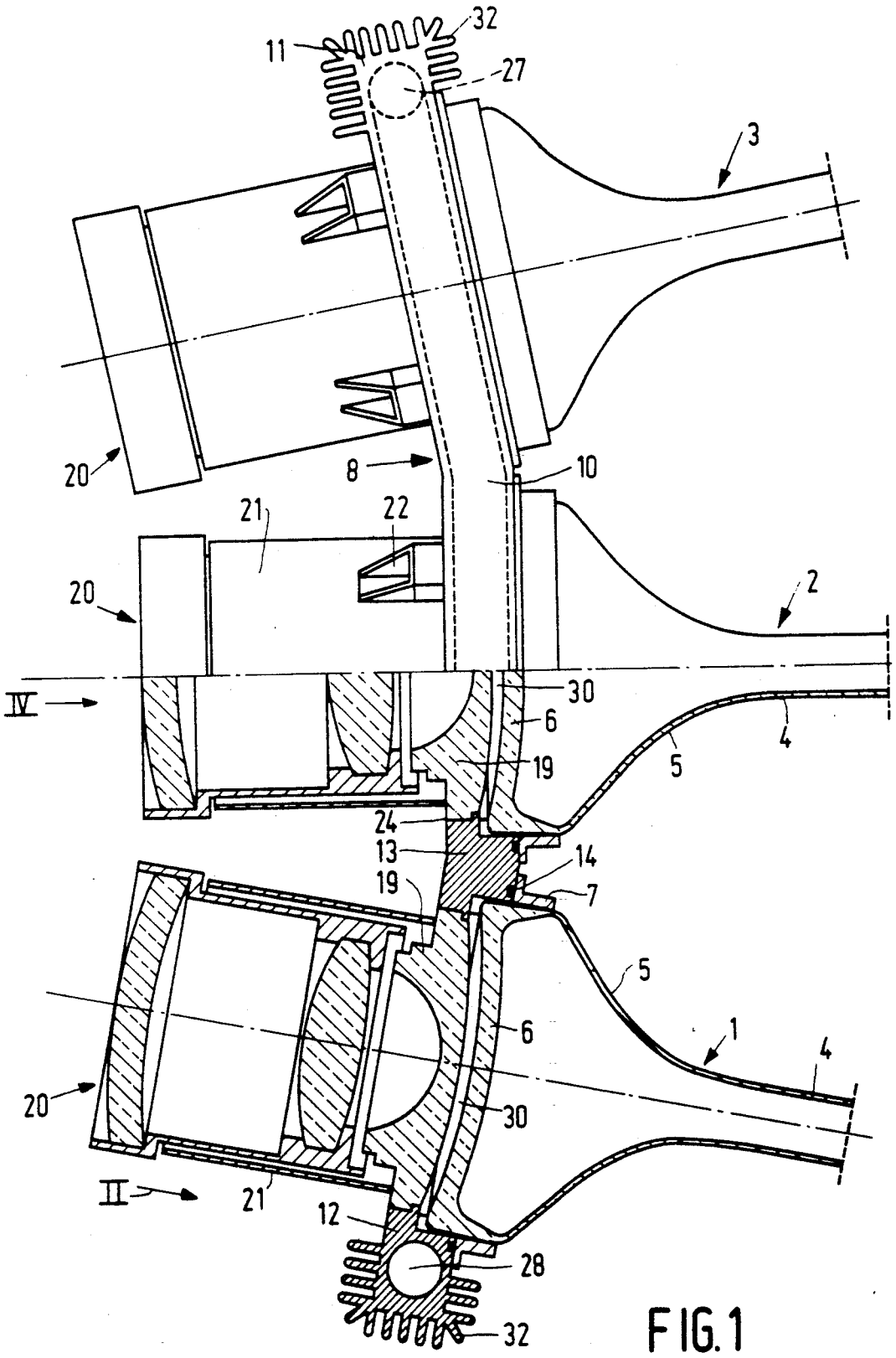
FIG. 1 shows partly in a plan view and partly in a cross-section a first embodiment of an assembly of three television picture tube having an integrated cooling which with associated lens systems are supported by a common frame.

FIG. 1 shows three television picture tubes 1–3 each having a neck 4, a conical portion 5 and a display window 6 having a display screen provided on its inner side in a manner not shown.

Each tube is surrounded near the display window 6 by a fillet 7 which is L-shaped in cross-section and is secured to the outer circumference of the relevant picture tube in such a manner that it does not pass liquid.

The picture tubes are supported by a metal frame 8, for example, of aluminium. The metal frame 8 has a lower hollow bar 9 and an upper hollow bar 10 extending parallel thereto. The ends of the two bars 9 and 10 are connected together by connection parts 11 and 12 which are likewise hollow and which together with the bars 9 and 10 constitute a rectangular frame. The two bars 9 and 10 are also connected together by solid connection parts 13 extending parallel to the bars 11 and 12. The end of the picture tube 1 having the display window 6 is incorporated in a recess in the frame 8, which recess is bounded by parts of the bars 9 and 10 and connection parts 12 and 13. Similarly, the the display window end of the picture tube 3 is incorporated in a recess in the frame 8, which recess is bounded by parts of the bars 9 and 10 and connection parts 11 and 13. Finally, the display window end of the tube 2 is located in a recess bounded by the central portions of the bars 9 and 10 and the two parts 13. The picture tubes are secured to the frame with the aid of fillets 7 surrounding the picture tubes with the interpositioning of a packing 14 incorporated in a groove 14 provided for that purpose in the frame 8, so that a liquid tight connection between the fillets 7 and the frame 8 is formed.

Figure 2:
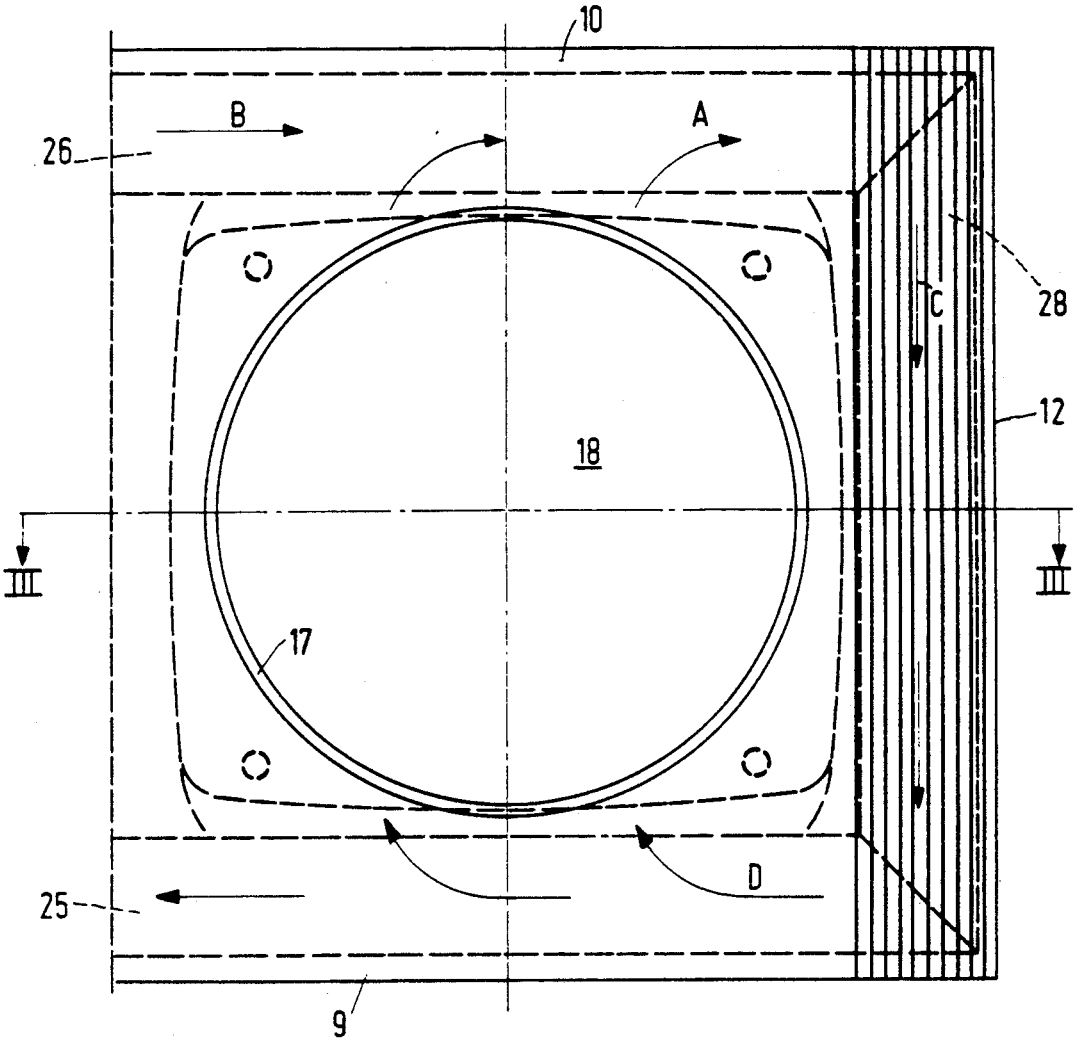
FIG. 2 is an elevational view of an end portion of the frame of the assembly of FIG. 1 in which the lens systems and the picture tubes, viewed in the direction of the arrow II in FIG. 1 have been omitted.
Figure 3:
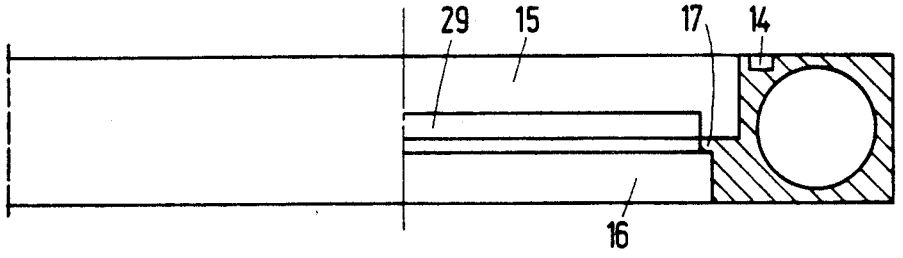
FIG. 3 is a cross-section of FIG. 2 taken on the line III—III in FIG. 2.
Figure 4:
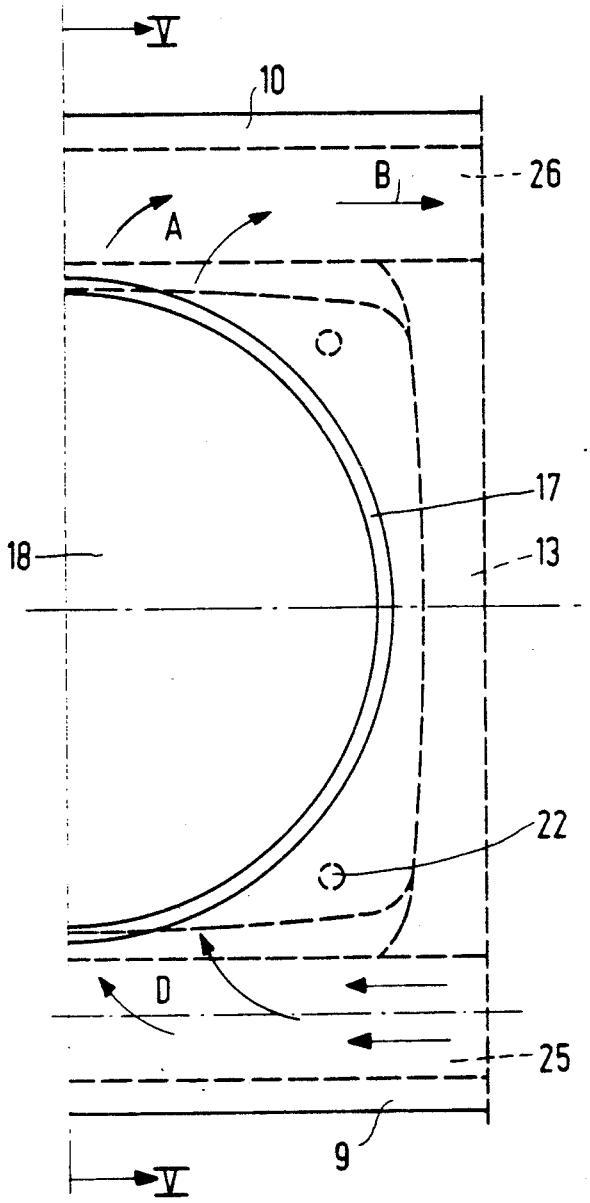
FIG. 4 is an elevational view of a central portion of the frame while omitting the lens systems and the television picture tubes, viewed in the direction of the arrow IV in FIG. 1.
Figure 5:
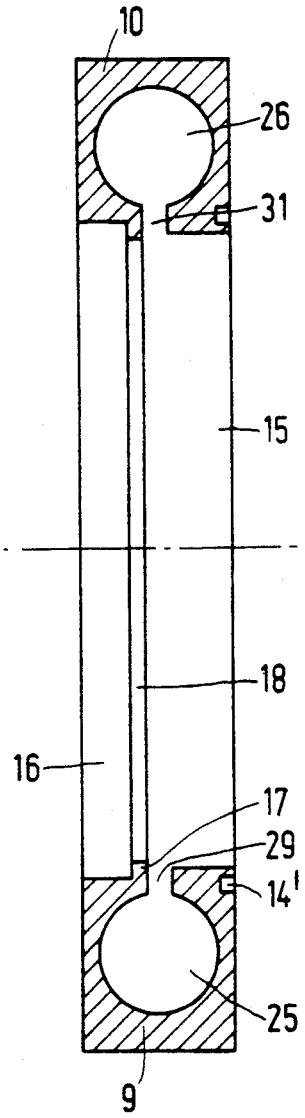
FIG. 5 is a cross-section of FIG. 4 taken on the line V—V in FIG. 4.

Referring to FIGS. 2 and 3, each rectangular portion 15 of the recess for incorporating one end of a picture tube changes into a portion 16 having a round cross-section of the relevant recess, a circular edge 17 being provided near the transition between the portions 15 and 16, which edge bounds a round hole 18 having a smaller diameter than portion 16.

A lens 19 of a lens system 20 is located in the hole 18 and the portion 16. The outer circumference of the lens 19 is formed stepwise, as is particularly apparent from FIG. 1, so that the outer circumference of the lens tightly fits in the hole 18 and the recess 16.

The lens system 20 has a jacket 21 provided with supports 22 which are secured to the frame 8 with bolts (not shown) whose screw-thread ends are screwed into threaded holes 22 provided in the frame. By providing a sealing connection 21 around the lens 19 a liquid tight connection between the lens 19 and the frame 8 is obtained.

A passage 25 is provided in the lower bar 9 of the frame 8 and a passage 26 is provided in the upper bar 10. Both passages 25 and 26 extend throughout the length of the bars 9 and 10 and their ends are connected by means of passages 27 and 28 extending through the connection bars 11 and 12, respectively.

At the area of each recess 14 a slit-shaped aperture 29 is provided in the upper wall of the hollow bar 9, which aperture constitutes a connection between the passage 25 and a space 30 (FIG. 1) bounded by the display window 6 and the lens 19. This space 30 is in open communication with the passage 26 provided in the bar 10 via a slit-shaped aperture 31 provided in the lower wall of the bar 10. The length of the slit-shaped apertures or slotted holes 29 and 31 is approximately equal to the width of the display window 6.

The passages 25-28 and the spaces 30 are filled with a suitable liquid A mixture of ethylene qlycol:water may be used as a coolant with a mixing ratio of preferably between 1:1 and 4:1. When the device is used the liquid present in the spaces 30 will be heated and consequently it will flow upwards through the spaces 30 to the passage 26 as is indicated by the arrows A (FIG. 2). In the upper passage the liquid, as indicated by the arrows B, will flow to the ends of a passage 26 and from this passage it will flow down via the passages 27 and 28, as is indicated by arrows C, to the passage 25 whence the liquid, as indicated by arrows D, flows into the spaces 30 again. To realize a satisfactory cooling of the liquid flowing through the passages, the relevant components such as, for example, the connection parts 11 and 12 may be provided with cooling ribs 32.

By using the construction according to the invention an effective cooling can be realized with a concise structure of the frame and picture tubes which are closely arranged so that the temperature can be kept at a proportionally low level while preventing large temperature differences over the height of the spaces 30. This makes it also possible to bound the flow space on the side remote from the picture tube directly by a lens of the lens system so that the use of a separate transparent sealing plate for sealing the flow space can be dispensed with.

The frame 8 may be made of one piece, or of separate components which are appropriately secured by using securing means or by welding and/or adhesive connections.

The above described embodiment of the invention is particularly suitable when two conditions are satisfied. Firstly, when the axis of the three tubes constitutes a sufficiently large angle with the vertical direction, for example, larger than 10 to 20 degrees in which case the coolant in front of the display screens of the tubes has a sufficiently slanting position to initiate a free convection caused by temperature differences Secondly, when the outside of the display window 6 and the side of the second light transmissive window, in this case the first lens element 19 facing that side, are in parallel with each other. The latter is the case in the device according to FIG. 1. This parallel position implies that the differences in refractive index caused by temperature differences in the coolant are less critical.

Figure 6:
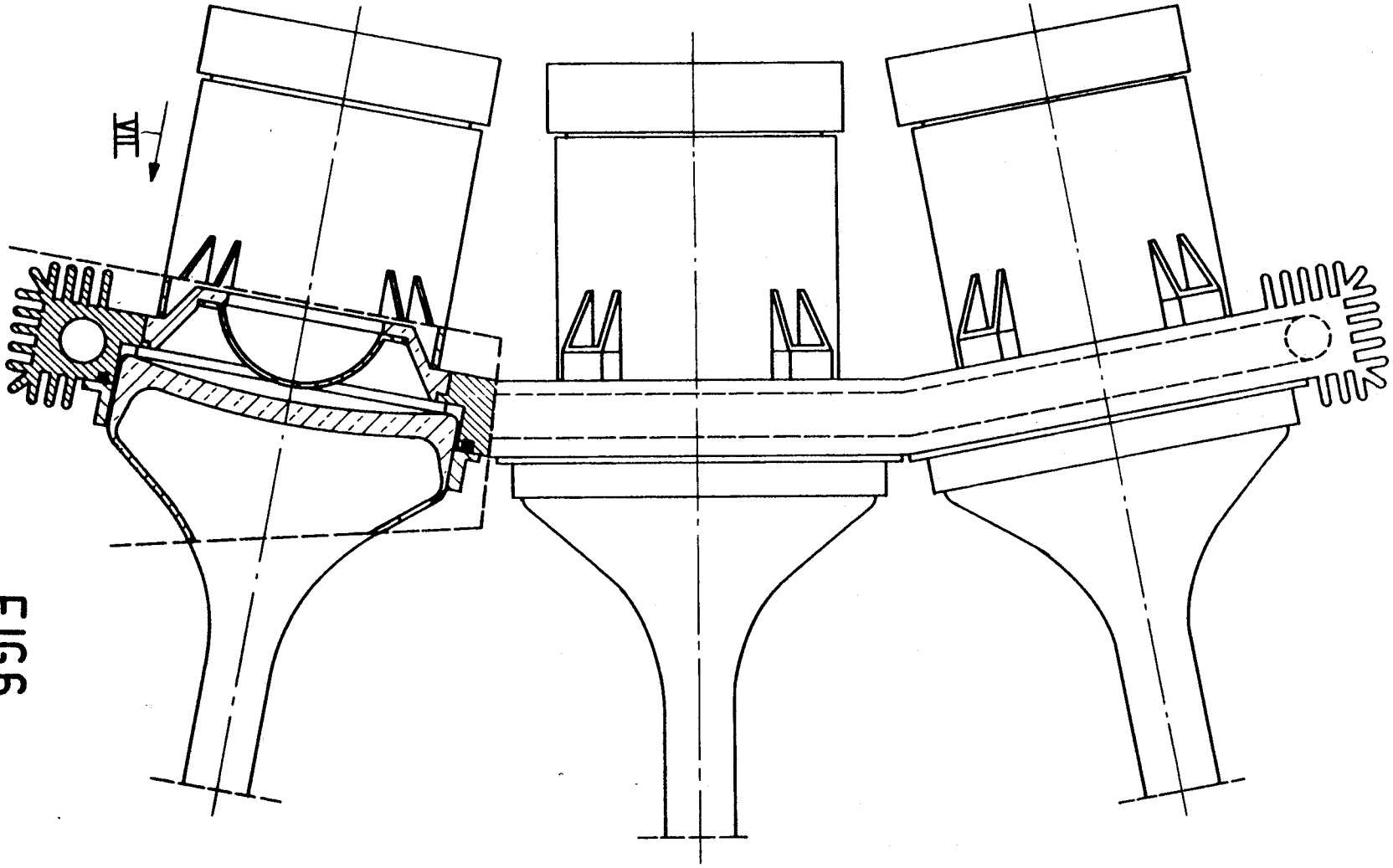
FIG. 6 shows partly in a plan view and partly in a cross-section a second embodiment of an assembly of three television picture tubes with integrated cooling, which with associated lens systems are supported by a common frame.
Figure 7:
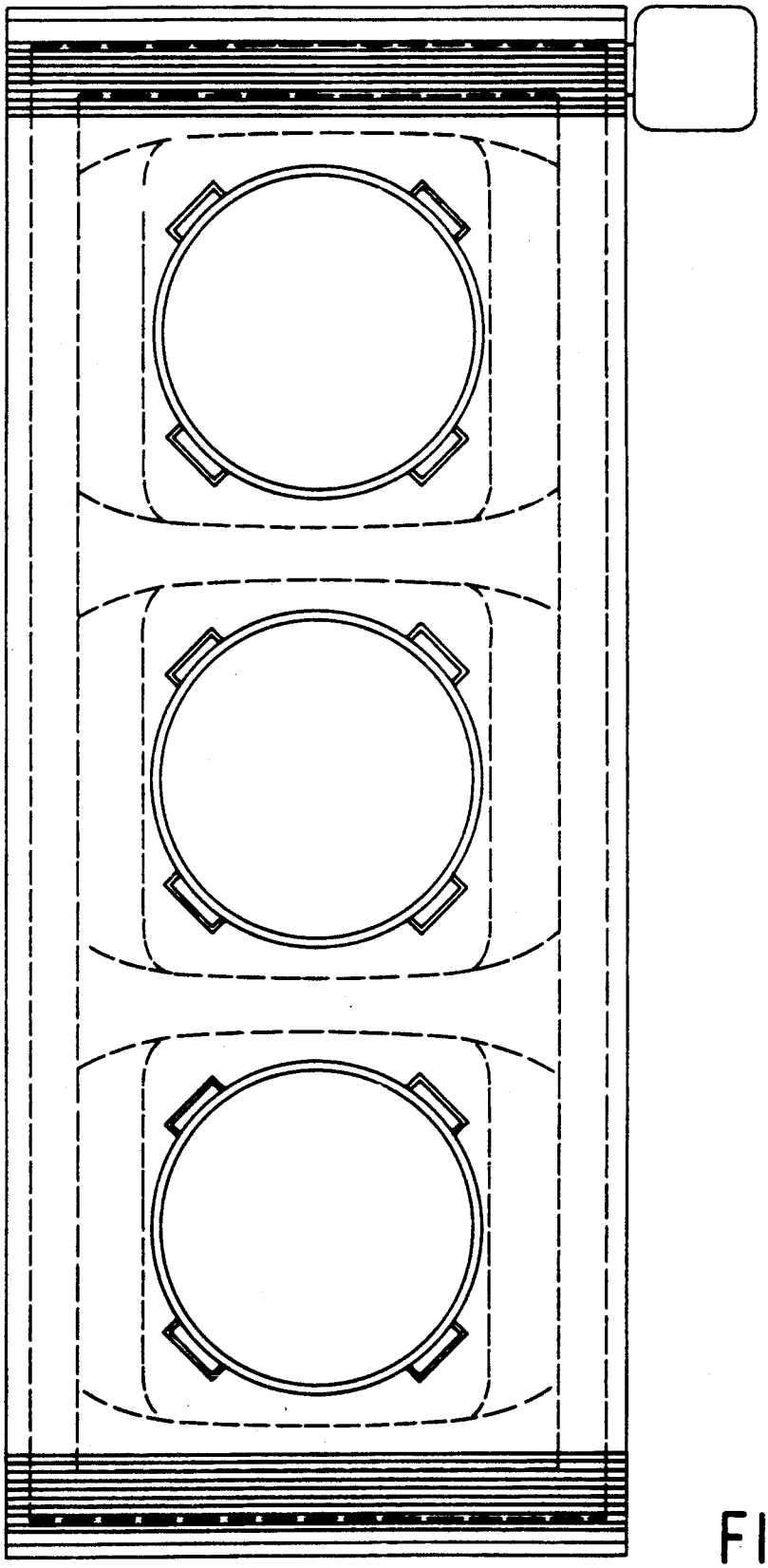
FIG. 7 is an elevational view of the frame of the assembly of FIG. 6 while omitting the lens systems and picture tubes viewed in the direction of the arrow VII in FIG. 6.

Referring to FIGS. 6 and 7, a second embodiment of the invention is a variant of the first embodiment in which the cooling duct which is common for the three tubes, for example, the passage 67 on one of the ends incorporates a small liquid pump 40 to accelerate the flow of the coolant. The capacity of the liquid pump is to be preferably in the range between 0.5 and 3 cc/sec. The passage 68 on the other end then works less effectively and may be dispensed with. As is common practice in projection television apparatus the projection tube 42 provided with a green emitting phosphor is placed in the centre and the tubes 41, 43 provided with blue and red phosphors are placed on either side. Since in the present state of the art concerning phosphors the tube 43 provided with the blue phosphor is to be subjected to a higher load than the tube 41 provided with the red phosphor, the pump 40 will be preferably placed on the end of the blue tube 43. With respect to the first embodiment of the invention the second embodiment is more complicated due to the presence of the pump 40. However, advantages are that the diameter of the passages around the three tubes can be reduced and that the second embodiment is also suitable when the axis of the tubes constitutes a small angle with the vertical. The second embodiment is, however, particularly suitable when the outside of the display window 46 and the inside of the first lens element 59 are no longer in parallel. As compared with the device shown in FIG. 1 there are three differences. Firstly the solid first lens element 19 in FIG. 1 whose thickness varies considerably with the distance to the optical axis is replaced by a thin meniscus lens 59 in FIG. 6. Secondly, the passages in FIGS. 6 and 7 have a smaller diameter. Thirdly, FIG. 7 shows a pump.

A great advantage of the thin meniscus lens 59 is that it can be manufactured in a much simpler and less expensive way than a thick first lens element commonly used for projection television (the so-called field flattener). As is apparent from FIG. 6, a drawback is that the coolant in front of the display window 46 varies considerably in thickness and hence in addition to cooling also functions as a lens Temperature differences and hence differences in density and refractive index in the coolant are therefore much more critical. The acceleration of the laminar liquid flow by means of a small pump will considerably reduce these temperature differences and therefore provide the possibility or facilitate the use of meniscus lenses. The display window 46 may either be flat or be curved towards the vacuum side as shown in FIG. 6.

In the two embodiments it is recommendable to provide an expansion space in order to compensate for the expansion of the coolant caused by an increase of the temperature of this liquid.

In summary the following principal features of the cooling system according to the invention can be mentioned:

1) the cooling which is integrated for three projection television tubes in which the tubes are in parallel as far as cooling is concerned so that the flow resistance is at a minimum, 2) the absence of coolant or cooling fins between the three tubes so that they can be placed closely beside each other and so that optical image errors are at a minimum, 3) the use of either free convection cooling without a pump as in embodiment 1, or only a pump for simultaneous cooling of the three tubes combined as in embodiment 2, 4) possible use of only one expansion space for the three tubes combined.

What is claimed is:

1. A device for projecting television pictures onto a projection screen by using three television picture tubes arranged in the proximity of each other, each comprising a display window having a display screen provided on the inside thereof and a light transmissive element arranged at a distance in front of the display window, which element together with the display window bounds a flow space for passing through a coolant, the flow spaces being in open communication with a liquid circuit for removing the heated coolant from and applying cooled liquid to the flow spaces, the liquid circuit comprising a first duct extending below the television picture tubes, which duct is in direct communication via passages with the lower ends of the flow spaces, and a second duct extending above the television picture tubes, which duct is in direct communication via passages with the upper ends of the flow spaces, whilst the first and the second duct are connected via at least one connection duct extending along the outer end of the assembly constituted by the three television picture tubes, characterized in that the first and the second duct at their both ends are connected by a connection duct, and further characterized in that the first and the second duct and the connection duct are passages in a frame supporting the television picture tubes.

2. A device as claimed in claim 1, characterized in that the frame comprises longitudinal bars extending below and above the television picture tubes, which bars are connected by means of connection parts at their ends and between the picture tubes.

3. A device as claimed in claim 2, characterized in that the frame is provided with recesses located at a distance from each other and between the connection parts, in which recesses one end of a picture tube is inserted from one side, whilst the recess on the other side is shut off by the light-transmissive element.

4. A device as claimed in claim 2, characterized in that the first and second ducts provided in the lower and upper longitudinal bars of the frame communicate with the flow spaces via slotted holes extending in the longitudinal direction of the longitudinal bars and provided in the upper side and the lower side, respectively, of said longitudinal bars.

5. A device as claimed in claim 2, characterized in that the connection parts at least comprising the connection ducts and connecting the ends of the longitudinal bars are provided with cooling ribs.

6. A device for projecting television pictures onto a projection screen comprising three television picture tubes arranged side by side, each having a display window with a display screen on the inside thereof, a light transmissive element arranged at a distance in front of each display window, which element together with the display window bounds a flow space for passing a coolant, a frame supporting said television picture tubes, said frame having therein a first duct extending below the tubes, which duct is in direct communication with the lower ends of the flow spaces via respective passages, a second duct extending above the tubes, which duct is in direct communication with the upper ends of the flow spaces via respective passages, and a connection duct connecting said first and second ducts, said connection duct extending along an outer end of the assembly constituted by the three tubes, said connection duct serving to return coolant from the upper ends of the flow spaces to the lower ends thereof.

7. A device as in claim 6 further comprising a pump incorporated in the connection duct.

8. A device as in claim 6 further comprising another connection duct extending along the opposed outer end of the assembly constituted by the three tubes, whereby two connection ducts connect said first and second ducts at opposed ends, and both serve to return coolant from the upper ends of the flow spaces to the lower ends thereof.

9. A device as in claim 7 wherein said frame constitutes a first longitudinal bar extending below said tubes and having said first duct therein, a second longitudinal bar extending above sad bars and having said second duct therein, which bars are connected by means of connection, bars at their ends and between the picture tubes, a connection bar at one end of the assembly having said connection duct therein.

10. A device as in claim 9 wherein said frame is provided with three spaced apart recesses, each recess lying between a pair of adjacent connection bars, each recess receiving one end of a picture tube from one side of said frame, the light transmissive elements being received against the frame from the other side thereof.

11. A device as in claim 10 wherein said passages comprise three slots in said first longitudinal bar and three slots in said second longitudinal bar, said slots extending in the longitudinal direction of said longitudinal bars.

12. A device as in claim 6 wherein at least the connecting bars having ducts therein are provided with cooling ribs.

13. A device as in claim 6 wherein the surface of each light transmissive element which facing the adjacent display window is parallel to the display window.

* * * * *